US006446921B1

(12) United States Patent
Maschhoff

(10) Patent No.: US 6,446,921 B1
(45) Date of Patent: Sep. 10, 2002

(54) COLLAPSIBLE DISPLAY STAND

(75) Inventor: Alan K. Maschhoff, Inyokern, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 29 days.

(21) Appl. No.: 09/676,766

(22) Filed: Oct. 2, 2000

(51) Int. Cl.[7] ..... A47F 5/10

(52) U.S. Cl. ..... 248/150; 248/174; 248/459; 248/460; 108/165; 108/167

(58) Field of Search ..... 248/179, 459, 248/460, 150; 108/165, 167

(56) References Cited

U.S. PATENT DOCUMENTS

| | | | | | |
|---|---|---|---|---|---|
| 1,565,026 | A | * | 12/1925 | Moore | |
| 1,835,714 | A | * | 12/1931 | McCausland | |
| 2,908,400 | A | | 10/1959 | Richter | |
| 3,420,362 | A | * | 1/1969 | Kleingers, Jr. | 206/45.14 |
| 3,647,111 | A | * | 3/1972 | Stager et al. | 220/83 |
| 3,721,413 | A | | 3/1973 | Robinson | |
| 3,836,104 | A | * | 9/1974 | Miller et al. | 248/150 |
| 4,128,167 | A | * | 12/1978 | Hogshead, III | 206/44 R |
| 4,309,948 | A | * | 1/1982 | Provost | 206/45.25 |
| 4,519,319 | A | | 5/1985 | Howlett | |
| 4,582,283 | A | * | 4/1986 | Schmitt | 248/174 |
| 4,773,622 | A | * | 9/1988 | Herlin | 248/174 |
| 4,834,450 | A | | 5/1989 | Stickler | |
| 4,926,759 | A | | 5/1990 | Vitsky | |
| 5,066,065 | A | * | 11/1991 | Baughman | 296/165 |
| 5,501,158 | A | * | 3/1996 | Cheney | 108/165 |
| 5,644,995 | A | * | 7/1997 | Gurwell et al. | 108/188 |
| 5,884,568 | A | | 3/1999 | Dombroski | |
| 6,048,032 | A | | 4/2000 | Stewart | |

* cited by examiner

*Primary Examiner*—Leslie A. Braun
*Assistant Examiner*—Steven M. Marsh
(74) *Attorney, Agent, or Firm*—Anthony J. Serventi

(57) ABSTRACT

The display utility stand of the present invention is an aesthetically pleasing and durable collapsible portable display stand, which incorporates a minimal number of movable parts. The display utility stand may be adapted for supporting and stabilizing a wide variety of shapes, sizes and weights. The main panels are connected by a pair of top support supported by a left side support and a right side support which are also connected to the main panels. The left and right side supports are hinged at a horizontal median point of the respective by one or more hinge means at the inner ends of the left and right side panels. The top support is located superior to each of the side supports and folds upward as the first and second main panels are pressed together and the display stand is converted into a collapsed condition for easy and safe transfer or storage. There is provided an optional fixture for supporting various shapes as well as an optional door for storage beneath the stand upon erection.

17 Claims, 4 Drawing Sheets

COLLAPSIBLE DISPLAY STAND

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

BACKGROUND OF THE INVENTION

1. Field of the Invention

This invention relates to a collapsible display stand having a minimum number of parts and more particularly to a collapsible display stand, which is adaptable to support and stabilize objects of varying shapes, weights and sizes.

2. Description of the Related Art

Folding or collapsible display and bench assemblies have seemingly been designed for the sole purpose of making a compact unit for storage, rather than for the purposes of compactness, durability and simplicity. Other types of assemblies may be comfortable, but frequently they are also large and bulky and therefore problematic in terms of both storage and transportation.

Detachable display units often require bolts, nuts, or screws, and tools for assembly. Thus, assembly and disassembly are not quickly or easily accomplished, and injuries may be caused by the tools. Furthermore, once the unit has been taken apart, the smaller components are easily lost and it is frequently difficult to remember how to reassemble the unit correctly without instructions (which inevitably disappear).

While many of the folding, collapsible, or detachable display and bench units taught by the prior art are meant to be portable, few make it far from the closet where they are stored. Generally they are bulky and/or heavy and not easily transported.

U.S. Pat. No. 5,501,158 issued to Cheney on Mar. 26, 1996 discloses a collapsible portable support apparatus for supporting a work piece or for providing an elevated working platform. The '158 Patent discloses a support having right and left hand end walls and a pair of platform panels that are adapted to swing between an upwardly folded and a generally horizontally extended position. However, additional support is provided by 2 pairs of right and left hand panels supports interdigitally related to one another with hinges connecting the various movable sections. The present invention utilizes a much less complex design to effectuate the result of support and collapses to form a safe generally geometric shape unlike the '158 Patent which collapses to form an odd shape with several sections jutting out from the end wall panel members. Additionally, the purpose of the present invention differs from the '158 Patent, in that, the '158 Patent provides a work piece and platform, whereas, the present invention is intended for use as a durable and aesthetically pleasing display stand. Also, the '158 Patent does not disclose a support that may be adapted to display and stabilize a wide variety of shapes and sizes.

U.S. Pat. No. 3,721,413 issued to Robinson on Mar. 20, 1973 discloses a display which may be folded into a generally flat form and which will erect into a display when a means holding the display folded is released. The display disclosed in the '413 Patent is generally for use in a supermarket. The '413 Patent incorporates a vertically elongated standard secured to a base and a display poster secured to the top of the standard. The '413 Patent utilizes more moving sections than the present invention and does not provide a mechanism for setting and stabilizing objects of varying shape on top of the display.

U.S. Pat. No. 5,644,995 issued to Gurwell et al. on Jul. 8, 1997 discloses a rapidly assembled and disassembled portable table or work bench. The table disclosed in the '995 Patent consists of four flat planar pieces that can be assembled and disassembled with or without fasteners. The '995 Patent does not incorporate hinged parts for easy erection of the table. Additionally, the purpose of the present invention differs from the '995 Patent, in that, the '995 Patent provides a work piece and platform, whereas, the present invention is intended for use as a durable and aesthetically pleasing display stand. Also, the '995 Patent does not disclose a support that may be adapted to display and stabilize a wide variety of shapes and sizes.

Therefore, a need exists for a collapsible, aesthetically pleasing display stand that has a minimum number of parts that require no fasteners, yet can withstand rugged use, and that provides substantial lateral stability, compression strength and safe, easy transfer.

SUMMARY OF THE INVENTION

The display utility stand of the present invention is a collapsible portable stand, which incorporates a minimal number of movable parts. A preferred embodiment of the present invention relates to display utility stands, and more particularly, to a display utility stand adapted for a variety of purposes. The display utility stand may be adapted for supporting and stabilizing a wide variety of shapes, sizes and weights. The present invention provides a durable, convenient, inexpensive collapsible display stand for presenting a wide variety of objects.

A preferred embodiment of the present invention provides a first and second main panels, which form a truncated triangular shape. The main panels are connected by a top support supported by a left side support and a right side support. The left and right side supports are each constructed of a pair of panels connected by a hinge mechanism, which enables the left and right side panels to alternate between a folded position and an extended position. The left and right side supports are connected to the first and second main panels in a generally vertical position. The left and right side panels are connected to the first and second main panels by one or more hinge mechanisms, so that the left and right side panels fold inward toward one another as the first and second main panels are pressed toward one another. Similarly, the top support is constructed of a pair of display base panels connected by one or more hinge mechanisms, which enables the display base panels to alternate between a folded position and a generally horizontal extended position. The top support is located superior to each of the side supports and folds upward as the first and second main panels are pressed together. In a preferred embodiment of the present invention, when the display stand is in a fully extended position, the bottom portion of the top support rests on top of the left and right side panels with the top support generally perpendicular to the left and right side panels for maximum support. However, the angle between the display base and left or right side panels may be increased beyond 90°.

In a preferred embodiment of the present invention, a groove is incorporated into the area of each of the main panels, which extend beyond the display base. The groove may be any one of a number of shapes depending upon the object to be displayed. For example, the groove may be circular for tubular objects like missiles and rockets, rectangular, octagonal and so on. Also, an accessory base may be placed on the display stand to support items like monitors, fax machines or telephones. In addition, support or personal items may be inserted through an optional door in one of the sides of the stand so as to be hidden in the space provided under the display stand when it is set up in an erected position.

In a preferred embodiment of the present invention, one or more fastening means are provided to secure the display stand when in a collapsed condition.

It is an object of the present invention to provide a display utility stand that is easily erected and deconstructed without tools.

It is a further object of the present invention to provide a display stand, which is sturdy when used, but which is easily collapsed for convenient storage, and which is fully portable.

It is a further object of the present invention to provide a display stand, which uses a minimum number of moving parts and to provide a durable, lightweight and reusable display stand that optionally may be weather resistant.

It is a further object of the present invention to provide an aesthetically delightful display stand, which may support and stabilize objects of varying size, shape and weight and optionally provides for storage of, and ready access to, material placed underneath the stand upon setup.

It is a further object of the present invention to provide a display stand, which collapses to form a safe, generally geometric shape for easy, safe storage and transfer.

DETAILED DESCRIPTION OF THE INVENTION

Figure 1:
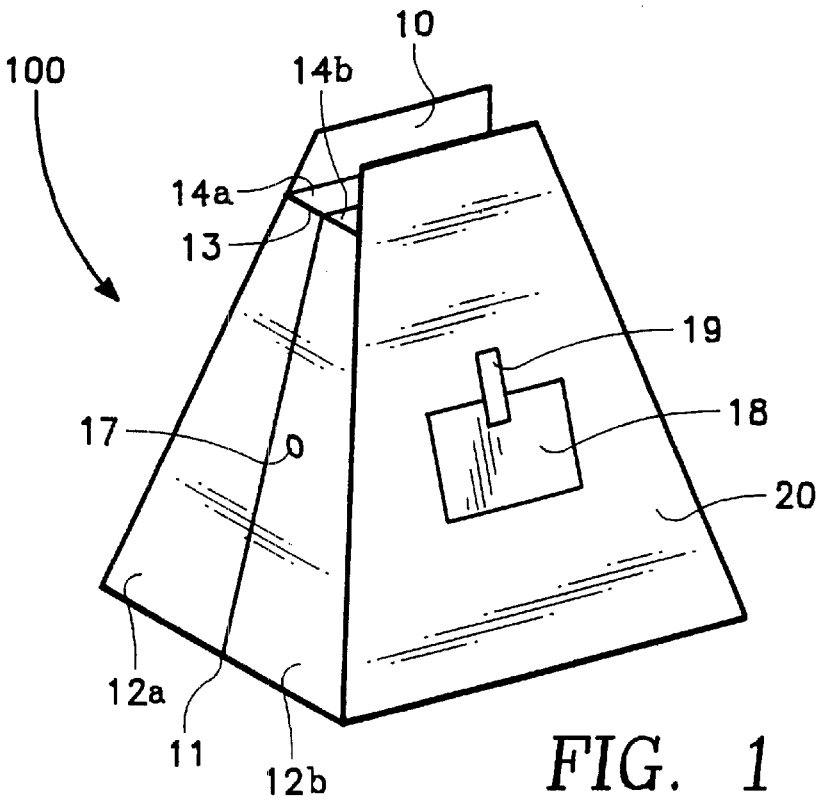
FIG. 1 is a left side perspective illustration of a preferred embodiment of the present invention showing an optional door on one side in an erected position with the top support generally perpendicular to the side panels.
Figure 2:
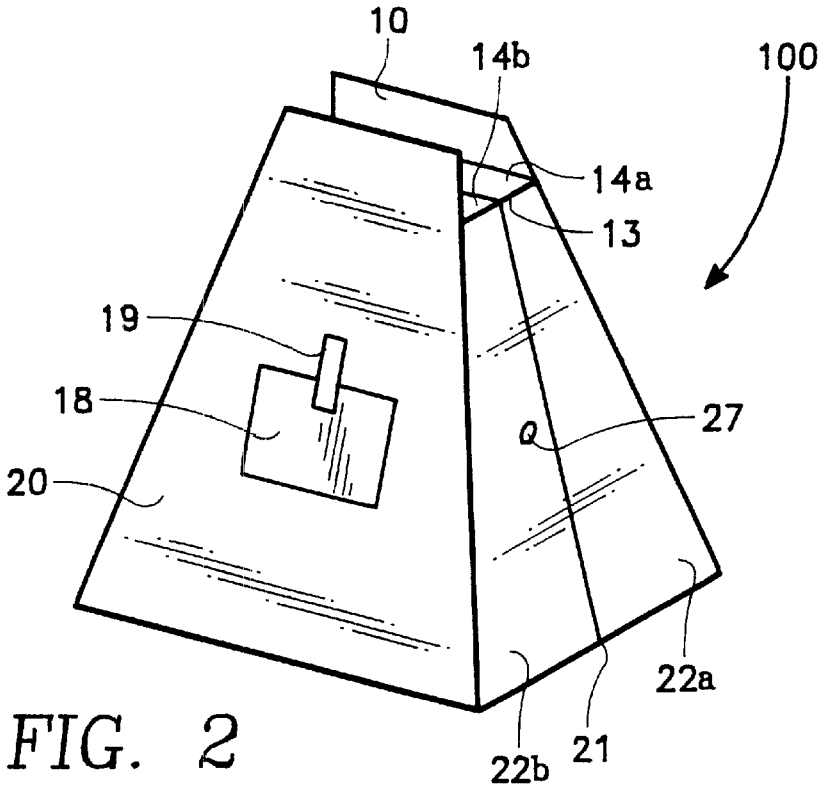
FIG. 2 is a right side perspective illustration of a preferred embodiment of the present invention in an erected position with the top support generally perpendicular to the side panels.
Figure 4:
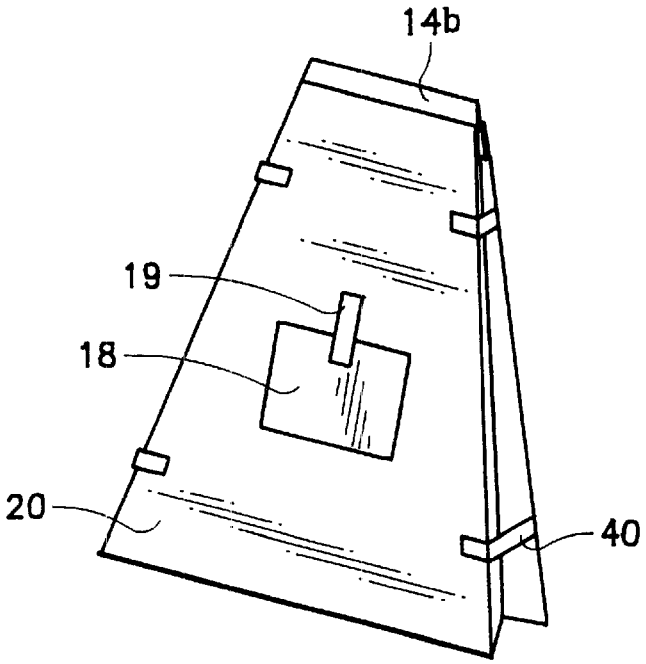
FIG. 4 is a side view illustration of a preferred embodiment of the present invention in a collapsed or in-folded position.

Referring first to FIG. 1, it will be seen that the display stand 100, which is described here by way of example for the purpose of illustrating the invention, comprises a first main panel 10 and a second main panel 20. In a preferred embodiment of the present invention, the main panels 10 and 20 are generally, a solid truncated pyramidal shape in elevation fixedly separated from one another. In the embodiment of FIG. 1, the respective upper ends of the main panels 10 and 20 extend beyond the top support 13, which separate the main panels 10 and 20. The top support 13 comprises a pair of display bases 14*a* and 14*b*, which are hinged attached by a hinged means 51 at a horizontal median point and connected at their respective outer ends to the main panels 10 and 20 by at least one hinged means 31*a* and 31*b*. The display bases 14*a* and 14*b* can be swung upwardly into a closed or folded position, as illustrated in FIG. 4, and swung downwardly into an out-folded or extended position, as illustrated in FIGS. 1 and 2.

Figure 3:
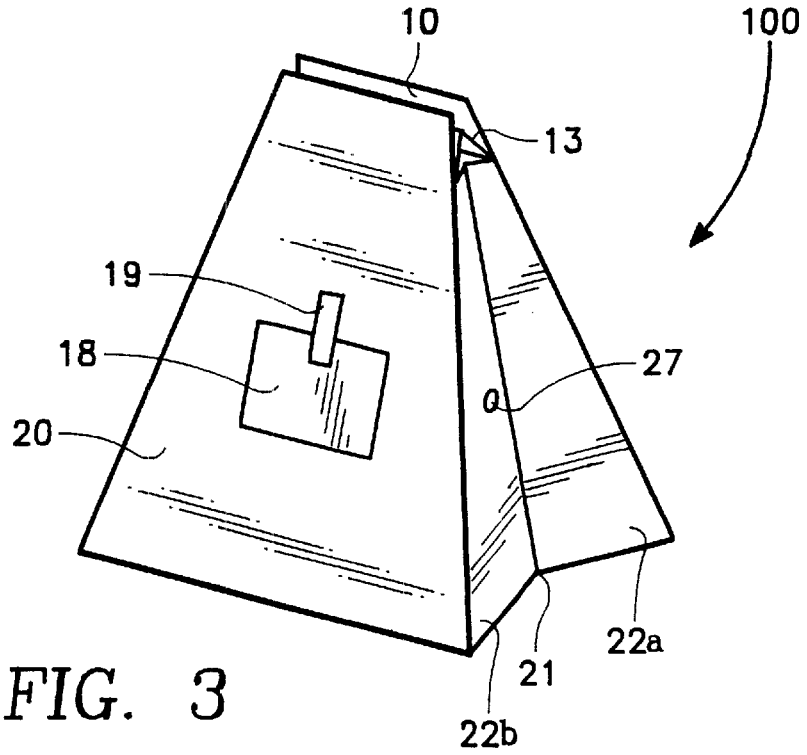
FIG. 3 is a bottom perspective illustration of a preferred embodiment of the present invention in a semi-erected position.
Figure 5:
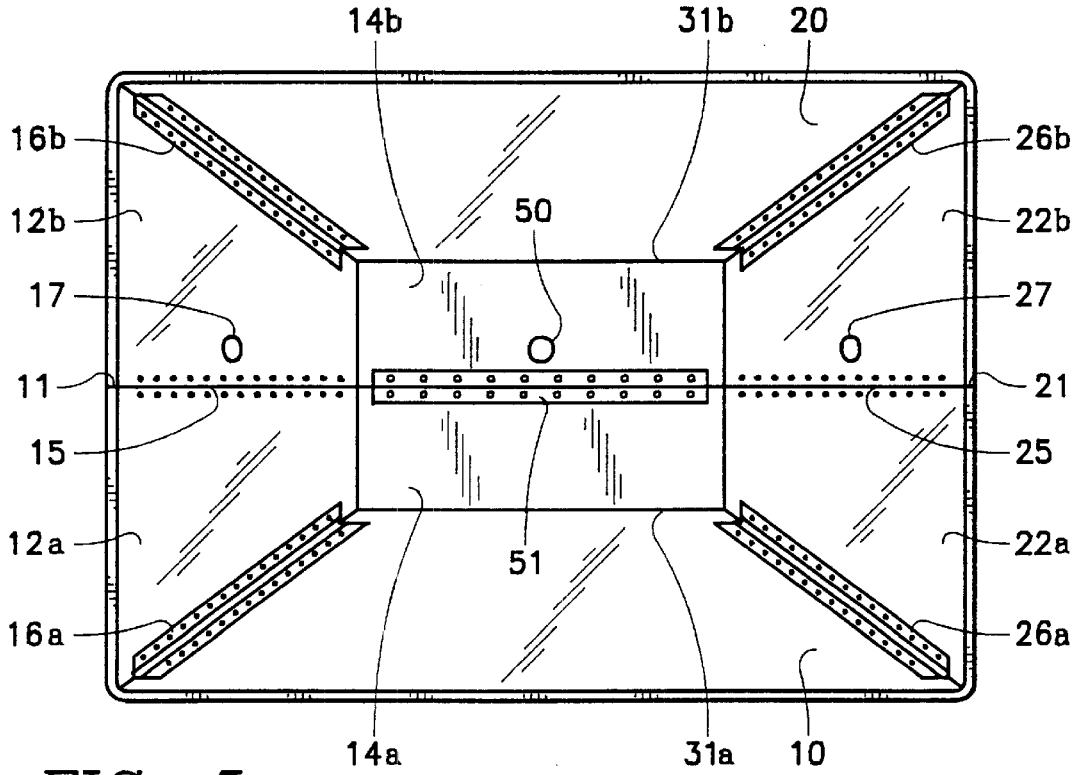
FIG. 5 is a bottom perspective illustration of a preferred embodiment of the present invention in an erect position.

In order to support the display bases 14*a* and 14*b* in their generally horizonatal extended position and to hold the main panels 10 and 20 in their angulated inwardly inclined spaced-apart position, when extended in use, there is provided a left side support 11 and a right side support 21. Referring to FIGS. 1 and 2, the left side support 11 comprising pair of left side panels 12*a* and 12*b* extend between the main panels 10 and 20 and the right side support 21 comprising a pair of right side panels 22*a* and 22*b* extend between the main panels 10 and 20. The left side panels 12*a* and 12*b* are hinged at a horizontal median point of the left support 11 by one or more hinge means 15 at the inner ends of the left side panels. Similarly, referring to FIG. 2, the right side panels 22*a* and 22*b* are hinged at a horizontal median point of the right support 21 by one or more hinge means 25 at the inner ends of the right side panels 22*a* and 22*b*. The outer ends of the left support 11 and right support 21 are connected between the main panels 10 and 20 by at least one hinge means 16*a*, 16*b*, 26*a* and 26*b*, as illustrated in FIG. 5. In a preferred embodiment of the present invention, one hinge means is utilized for each of the top, left side and right side supports 13, 11 and 21, as illustrated in FIGS. 1, 2 and 3. In a preferred embodiment, one hole 17, 27 and 50 or more are cut into either or both of the left side panels 12*a* and 12*b*, the right side panels 22*a* and 22*b* and the display bases 14*a* and 14*b* to assist a user in collapsing and erecting the display stand 100. The user may insert a finger or hook into a hole 17, 27 and 50 and pull out to erect the display stand 100. In addition, any hole may be used as an access for lines such as electrical cords, wires and rope.

Referring to FIG. 1, in a preferred embodiment of the present invention, a door 18 is added to the display stand 100. More preferably, the door is added to either or both of the main panels 10 and 20 so that, required weight strength is maintained. The door 18 provides easy access to items that may be stored stored under the display stand 100. Most preferably, the lower end of the door 18 is hingedly affixed to either of the main panels 10 and 20 and secured to the display stand 100 with a VELCRO® fastener 19 or other securing device such as a strap, magnet, clip and hook.

Figure 8:
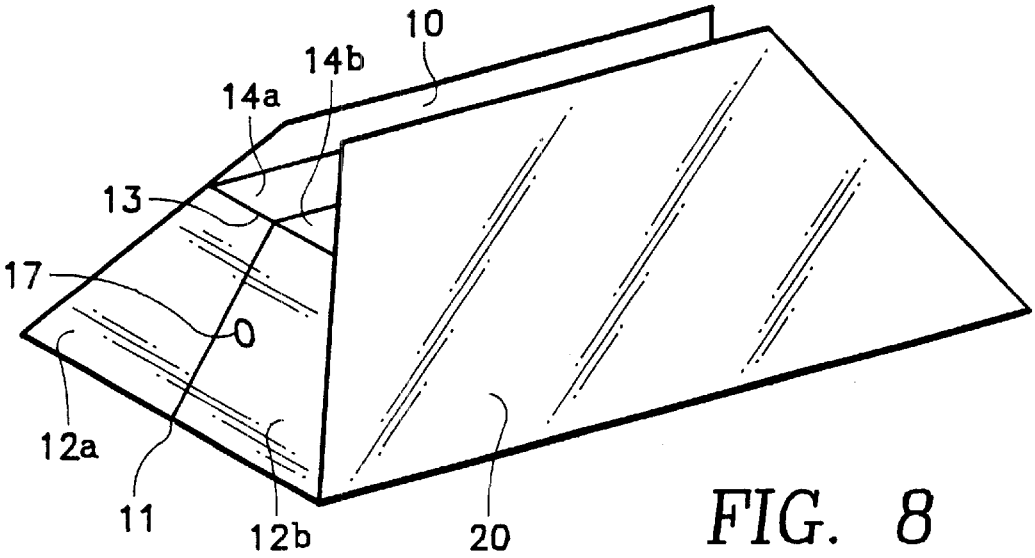
FIG. 8 is a side perspective illustration of a preferred embodiment of the present invention in an erected position with the angle between the display base and the side panels greater than 90°.

In a preferred embodiment of the present invention, when the display stand 100 is in its fully erected position, the bottom portion of the top support 13 rests on top of the left and right side supports 11 and 21 with the top support 13 generally perpendicular to the left and right side supports 11 and 21 for maximum strength. However, the angle between the top support 13 and left or right side supports 11 and 21 may be increased beyond 90° for improved stabilization, as illustrated in FIG. 8.

In a preferred embodiment of the present invention, the first and second left and right side supports 11 and 21 are constructed with hinges 15 and 25 as illustrated in FIG. 5. In a preferred embodiment of the present invention, the axes of the hinges 15 and 25 are such that when the side supports 11 and 21 are in their extended position, they are further apart at their lower ends and are inclined together towards their upper ends, as illustrated in FIGS. 1, 2, 5 and 8.

Referring to FIG. 3, a semi-erected position is illustrated. When the display stand 100 is converted to collapsed condition, as illustrated in FIG. 4, a convenient travel friendly article is created. Referring to FIGS. 3 and 4, as the main panels 10 and 20 are compressed toward one another, the hinge mechanisms of the various components transfer the top support 13, left side support 11 and right side support 21 from an extended position to a folded position. The display bases 14*a* and 14*b* of the top support 13 swing upward and abut one another after the conversion to a fully collapsed condition is completed. The left side panels 12*a* and 12*b* of the left side support 11 swing inward toward the right side support 21 and abut one another after the conversion to a fully collapsed condition is completed. Similarly, the right side panels 22*a* and 22*b* of the right side support 21 swing inward toward the left side 11 support and abut one another after the conversion to a fully collapsed condition is completed. As illustrated in FIG. 4, when in a collapsed condition, the collapsible display stand 100 of the present invention promotes safe transfer and storage by preventing harmful edges from jutting out from between the main panels 10 and 20. The main panels 10 and 20 may be fastened together, e.g. by VELCRO® straps 40, hooks or any other fastening mechanism. Also, the stand may be carried by handles, which may be retractable, connected to any area of the stand.

Figure 6:
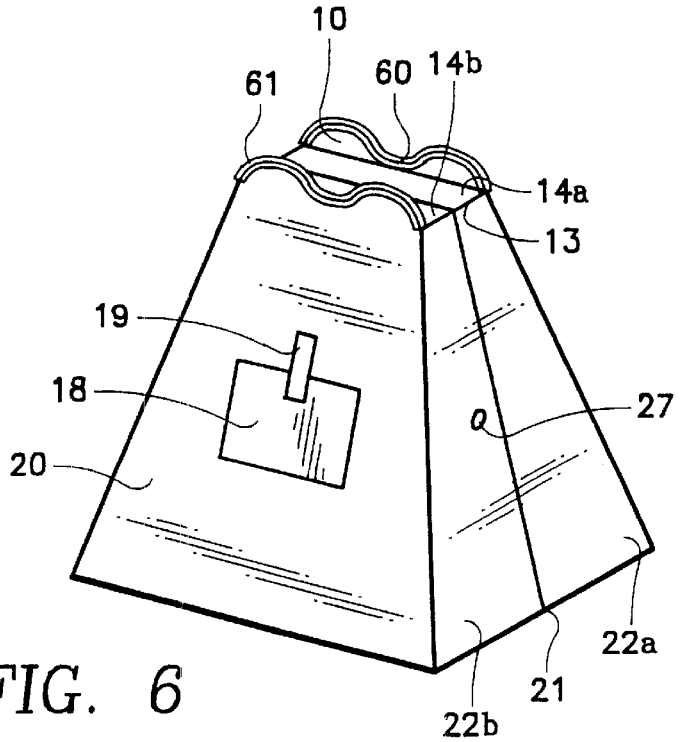
FIG. 6 is a side perspective illustration of a preferred embodiment of the present invention in an erected position having a circular groove at the top of each of the main panels, so that this embodiment of the invention may support and stabilize a missile-shaped object.

Referring to FIG. 6, in a preferred embodiment of the present invention, a circular groove 60 is incorporated into the upper end of each of the main panels 10 and 20, which extend beyond the top support 13. The groove 60 is circular in order to accommodate a tubular object, such as a missile or carpet roll, as illustrated in FIG. 6. However, the groove 60 may be designed to accommodate any one of a number of other shapes depending upon the object to be displayed. For example, depending upon the shape of the object to be displayed, the groove may be rectangular, octagonal, etc. In a preferred embodiment of the present invention, the upper end of each of the main panels 10 and 20 is covered in a protective material, because contact with the construction material of the display stand 100 may cause damage to an object intended to be displayed. This contact may also cause damage to the display stand. The protective material prevents damage to the display stand and objects that are intended to be display by creating a protective barrier 61 between the display stand 100 and the object. The protective material of the protective barrier 61 may be any commonly used trim material such as rubber, latex or plastic.

Figure 7:
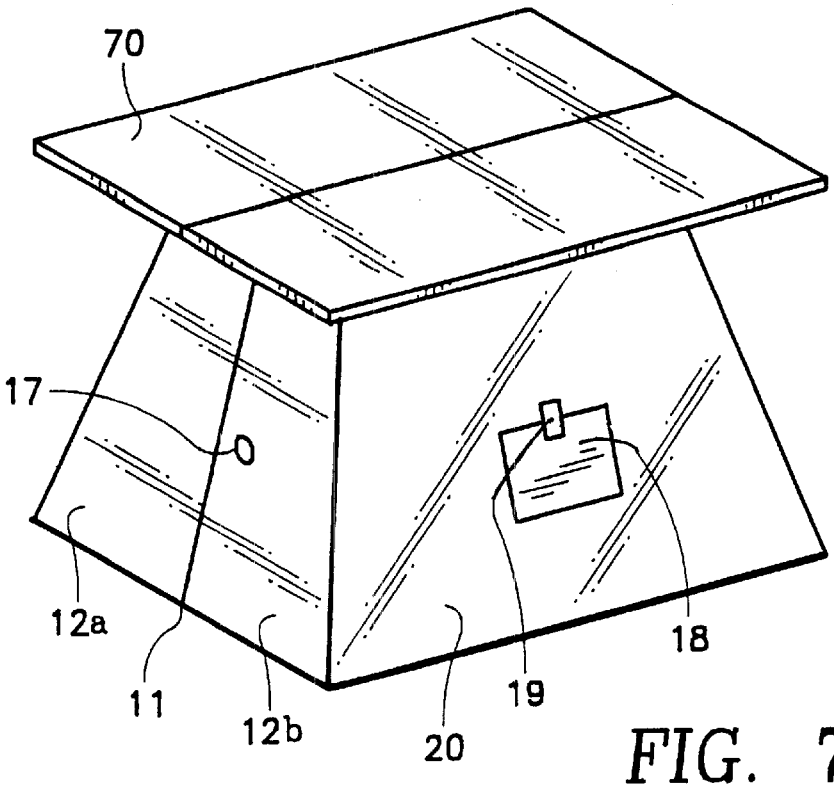
FIG. 7 is a side perspective illustration of a preferred embodiment of the present invention in an erected position, in which the invention is supporting and stabilizing a rectangular accessory base.

Referring to FIG. 7, a substantially horizontal accessory base 70 placed upon the first and second main panels 10 and 20 may be incorporated in order to support displayed objects which require a flat surface. The accessory base 70 may be any of a number of shapes and sizes, depending on the object to be set upon the main panels 10 and 20 and the size display utility stand 100. The accessory base 70 may be rectangular, square, circular, triangular, etc.

Referring to FIG. 8, a preferred embodiment of the present invention in an erect position. The angle between the top support 13 and the left side support 11 is between approximately 90° and 180°. Also, the angle between the top support 13 and the right side support 21 is between approximately 90° and 180°.

In a preferred embodiment of the present invention, the collapsible display stand 100 is constructed of thin sheets of a suitable durable material "sandwiched" by even thinner sheets of aluminum to yield an overall panel thickness from about 1–6 mm. The total thickness of the resultant "sandwich" is typically from 1.5–4 mm and is determined by the strength required of the stand for its intended application. Examples of suitable "sandwich" materials include 4 mm ALUCOBOND®, 4 mm DIEBOND® or any other sturdy durable material such as wood, stainless steel or plastic for the outer layers and PVC, closed cell foam, or similar for the "sandwiched" layer. Both outer layers need not be constructed of the same material. The inner layer is normally a material different from at least one of the outer layers. ALUCOBOND®, a composite consisting of two sheets of 0.20 mm aluminum sandwiching a polyvinyl chloride (PVC) or polyethylene core (~3 mm), is one of the most preferable, because of a high strength-to-weight ratio and good weather resistance of its PVC core. In other embodiments, the display stand may be constructed of wood, metal or plastic. To improve appearance and aesthetic enjoyment, the collapsible display stand 100 may be covered in fabric or felt. In that embodiment, VELCRO® straps are easily utilized with the fabric or felt serving as a receptor for the hoop for the door 18 strap and the fastener for maintaining the collapsed condition. In another preferred embodiment of the present invention, the various hinge means are hinges, which are constructed of a safe durable material such as stainless steel, brass or copper. However, the various hinge means could be elastic connectors or plastic connectors secured to the various panels and supports.

Although the description above contains many specificities, these should not be construed as limiting the scope of the invention but as merely providing an illustration of the presently preferred embodiment of the invention. Thus the scope of this invention should be determined by the appended claims and their legal equivalents.

What is claimed is:

1. A collapsible support apparatus having a minimum number of parts for supporting items comprising:

a first main panel and a second main panel, each of said main panels having an upper end and a lower end;

a top support having a first display base and a second display base, each of said display bases having an outer end and an inner end, wherein the outer end of said first display base is hingedly connected to said first main panel and the outer end of said second display base is hingedly connected to said second main panel, and wherein the inner end of said first display base is hingedly connected to the inner end of said second display base, so that said display bases swing between upwardly folded positions and horizontally extended positions;

a left support having a first left side panel and a second left side panel, each of said left side panels having an outer end and an inner end, wherein the outer end of said first left side panel is hingedly connected to said first main panel and the outer end of said second left side panel is hingedly connected to said second main panel, and wherein the inner end of said first left side panel is hingedly connected to the inner end of said second left side panel, so that said left side panels swing between longitudinally folded positions and generally vertical extended positions; and a right support having a first right side panel and a second right side panel, each of said right side panels having an outer end and an inner end, wherein the outer end of said first right side panel is hingedly connected to said first main panel and the outer end of said second right side panel is hingedly connected to said second main panel, wherein the inner end of said first right side panel is hingedly connected to the inner end of said second right side panel, so that said right side panels swing between longitudinally folded positions and generally vertical extended positions, and wherein said first and second left side panels fold inward toward said first and second right side panels and said first and second left right side panels fold inward toward said first and second left side panels.

2. The collapsible support apparatus of claim 1 in which each of said panels is constructed of a thin sandwich of material, the sandwich consisting of two outer skins and an inner filling material.

3. The collapsible support apparatus of claim 1 wherein said panels have a thickness from 1 mm to 6 mm.

4. The collapsible support apparatus of claim 1 wherein said panels have a thickness from 3 mm to 5 mm.

5. The collapsible support apparatus of claim 1 wherein said panels are constructed of materials selected from the group consisting of: a sandwiched material having a metal skin and a non-metal filling, a sandwiched material having an aluminum skin and a PVC filling, and a sandwiched material having a skin consisting essentially of a composite material and a filling consisting essentially of an electrically non-conducting material.

6. The collapsible support apparatus of claim 1, wherein the upper end of each of said main panels extend beyond said display base, further comprising a groove in the upper end of each of said main panels, in which said main panels incorporate said grooves in a shape similar to an object to be placed upon said collapsible support apparatus, so that the object is stabilized by said collapsible support apparatus.

7. The collapsible support apparatus of claim 6, wherein said groove is a semi-circular shape, so that said collapsible support apparatus may support and stabilize a missile-shaped object.

8. The collapsible support apparatus of claim 1, further comprising a substantially horizontal accessory base set on the top of said first and second main panels, wherein said accessory base supports and stabilizes an object placed upon said accessory base.

9. The collapsible support apparatus of claim 1, wherein each of said display bases is rectangular.

10. The collapsible support apparatus of claim 1, wherein said first and second display bases are of a predetermined length between said first and second main panels when in a horizontally extended position, and wherein the bottoms of said first and second main panels are spaced apart of a length greater than said predetermined length when said first and second display bases are in a horizontally extended position.

11. The collapsible support apparatus of claim 1, wherein said collapsible support apparatus further comprises means for locking said main panels to one another when said collapsible support apparatus is in a collapsed condition.

12. The collapsible support apparatus of claim 1, wherein a first angle between said top support and said left side support is between approximately 90° and 180° and a second angle between said top support and said right side support is between approximately 90° and 180° when said collapsible support apparatus is in its erected position.

13. The collapsible support apparatus of claim 1, wherein either of said left side panels has a small opening, wherein either of said right side panels has a small opening and wherein either of said display bases has a small opening.

14. The collapsible support apparatus of claim 1, wherein the upper end of each of said main panels is covered with protective barrier, wherein said protective barrier comprises a material selected from the group consisting of rubber, latex and plastic.

15. The collapsible support apparatus of claim 2, wherein the upper end of each of said main panels is covered with a protective barrier, wherein said protective barrier comprises a material selected from the group consisting of rubber, latex and plastic.

16. The collapsible support apparatus of claim 1, further comprising a door having a perimeter located in either of said main panels.

17. The collapsible support apparatus of claim 16, wherein a portion of said perimeter of said door is hingedly attached to either of said main panels and wherein said door is secured in a closed position by a securing means selected from the group consisting of a strap, magnet, clip and hook.

* * * * *